US006032454A

United States Patent [19]

Damour et al.

[11] Patent Number: 6,032,454

[45] Date of Patent: Mar. 7, 2000

[54] COMPOSITE YARN

[75] Inventors: Francois Xavier Damour, Lyons; Yves Pronzati, Chavanoz, both of France

[73] Assignee: Chavanoz Industrie, Chavanoz, France

[21] Appl. No.: 09/171,420

[22] PCT Filed: Apr. 16, 1997

[86] PCT No.: PCT/IB97/00413

§ 371 Date: Nov. 5, 1998

§ 102(e) Date: Nov. 5, 1998

[87] PCT Pub. No.: WO97/42363

PCT Pub. Date: Nov. 13, 1997

[30] Foreign Application Priority Data

May 7, 1996 [FR] France ..... 96 05942

[51] Int. Cl.[7] ..... D02G 3/36

[52] U.S. Cl. ..... 57/904; 57/210; 57/232

[58] Field of Search ..... 57/210, 224, 231, 57/232, 904

[56] References Cited

U.S. PATENT DOCUMENTS

| | | | |
|---|---|---|---|
| 4,127,698 | 11/1978 | Shimizu et al. | 428/373 |
| 4,381,639 | 5/1983 | Kress | 57/229 |
| 4,921,456 | 5/1990 | Tolbert et al. | 428/373 |
| 5,506,043 | 4/1996 | Lilani | 57/210 |
| 5,540,980 | 7/1996 | Tolbert et al. | 428/215 |

FOREIGN PATENT DOCUMENTS

| | | | |
|---|---|---|---|
| 0 385 025 A2 | 9/1990 | European Pat. Off. . | |
| 2087803 | 12/1971 | France . | |
| 2 494 313 | 5/1982 | France . | |
| 58-185637 | 10/1983 | Japan . | |
| 3-59134 | 3/1991 | Japan . | |
| 1593048 | 7/1981 | United Kingdom | 57/904 |

*Primary Examiner*—William Stryjewski
*Attorney, Agent, or Firm*—Oliff & Berridge, PLC

[57] ABSTRACT

A composite yarn includes a core composed of a continuous yarn, and a coated sheath composed of a matrix including at least one chlorinated polymer material, and a fire-retarding filler incorporated into and distributed within said matrix, wherein, in combination, the fire-retarding filler comprises a ternary composition which combines an oxygenated antimony compound, a hydrated metal oxide, the metal of which is chosen from aluminum, magnesium, tin, zinc and lead, and a zinc borate and, together with said ternary composition, the total weight content of inorganic matter in the yarn is between 4% and 65%.

20 Claims, No Drawings

COMPOSITE YARN

BACKGROUND OF THE INVENTION

1. Field of the Invention

The present invention relates to a composite yarn for technical or industrial use, which can be assembled into all types of textile structures, especially suitable textile surfaces, in order to meet any particular application or specification, for example for the manufacture of blinds or curtains.

2. Description of Related Art

In the prior art, document U.S. Pat. No. 4,127,698 discloses the production of fire-retarding composite fibers comprising a mixture of two fibers. The first, termed the matrix fiber, is based on PVC and partially acetalized PVA and furthermore includes an inorganic fire retardant consisting of a hydrated tin oxide and a hydrated antimony oxide. The second fiber is based on polyester, acrylic or cotton.

Document EP-A-0,385,025 describes the manufacture of a composite yarn comprising a core made of glass fibers and a sheath obtained by spinning low-melting-point fibers, for example cotton fibers.

However, these documents essentially relate to yarns obtained by spinning mixtures of fibers and are not appropriate to the applications envisaged below.

Moreover, high-performance composite yarns are already known, which the Applicant manufactures and sells, comprising:

- a core composed of a continuous yarn, for example a glass yarn;
- and a coated sheath composed of a plastic matrix consisting of at least one chlorinated polymer material, for example a polyvinyl chloride;
- a fire-retarding inorganic filler incorporated into and distributed within said matrix;
- and a plasticizer.

Preferably, but not exclusively, such a yarn is obtained by coating the core with a plastisol comprising the chlorinated polymer material, for example polyvinyl chloride, and the plasticizer, and then by gelling the plastisol around the core.

High-performance woven fabrics obtained from such yarns, when they are employed in various environments, especially for fitting out both the interior and exterior of properties or constructions, for example as blinds, are subject to fire-behavior requirements defined by national or international homologation or authorization procedures and/or regulations.

Thus, the regulations applicable to such woven fabrics in the Federal Republic of Germany define various classes which are characterized especially by the length of the specimen destroyed by fire and by the temperature of the combustion smoke and are identified by the letters B1 to B3, the letter B1 characterizing the best fire behavior attainable by a material comprising organic matter.

As regards the regulations applicable in France, these also define various classes which, on the one hand, are characterized especially by the emission of smoke and identified by the letters F0 to F5, F3 being the best behavior attainable by a material containing a halogenated polymer, and which, on the other hand, are characterized especially by the residual ignition temperature of the woven fabric and are identified by the letters M0 to M4, the letter M1 identifying the best fire behavior generally attainable by a material comprising organic matter.

At the present time, high-performance woven fabrics obtained from the composite yarns defined above have a certain limitation in terms of their fire behavior, this limitation being illustrated by the fact that such woven fabrics have never been able, without a chemical treatment after they have been woven, to achieve the B1 classification of the German regulations together with the M1 classification of the French regulations.

The main reason for the limitations mentioned above obviously stems from the organic nature of certain constituents of the composite yarn, especially the chlorinated polymer material and the plasticizer, or indeed certain coating additives.

Various attempts have been made to improve the intrinsic fire behavior of these composite yarns, for example by using special plasticizers such as organic phosphates. Unfortunately, by using such plasticizers the processing characteristics (flexibility, gliding power, etc.) of these yarns suffer, which impairs their subsequent weaving and makes the latter more difficult. Moreover, the incorporation of such plasticizers increases the smoke index.

Nor is it possible to increase the proportion by weight of the fire-retarding filler significantly, except, as previously, to the detriment of the processing characteristics of the composite yarn.

With regard to the performance of the fire-retarding filler proper, various documents have proposed different kinds of compounds or compositions capable of improving the fire behavior of the plastic matrices into which the fire-retarding filler is incorporated, but without the application or forming of the fire-retarded plastic, for example into a yarn, being specified.

Thus, in the case of a matrix based on polyvinyl chloride, document JP-A-58,185,637 has proposed a fire-retarding filler comprising a chlorinated polyethylene, a compound chosen especially from antimony and aluminum oxides and/or hydroxides, and preferably another compound chosen from certain zinc salts, including zinc borate.

Again, in the case of a matrix based on polyvinyl chloride, which also incorporates a stabilizer, a plasticizer consisting of a phosphoric ester, and an alumina hydroxide filler, document FR-A-2,448,554 has proposed a fire-retarding filler comprising an antimony oxide, optionally combined with a zinc borate.

SUMMARY OF THE INVENTION

None of the previously proposed fire-retarding fillers is suitable for improving the fire behavior of a composite yarn as considered above.

The subject of the present invention is a composite yarn, as defined above, having generally and intrinsically improved fire behavior, expressed both by a substantial decrease in the temperature of the combustion smoke and by a substantial reduction in the residual ignition threshold of the various woven fabrics obtained from the yarn according to the invention, in such a way that, in particular, such woven fabrics can meet both the current B1 classification of the German regulations (DIN Standard N04102 Part 1) and the current M1 and F3 classifications of the French regulations (NFP Standard 92503), all this without impairing the processing characteristics of the actual yarn which are required for weaving.

DETAILED DESCRIPTION OF PREFERRED EMBODIMENTS

According to the present invention, it has been discovered that the aforementioned objectives could be met by combining two essential characteristics, namely:

(a) choosing a ternary composition for the fire-retarding filler, which combines:

an oxygenated antimony compound, for example antimony trioxide ($Sb_2O_3$) or pentoxide;

a hydrated metal oxide, the metal of which is chosen from the group consisting of aluminum, magnesium, tin, zinc and lead, for example alumina hydrate ($Al_2O_3.3H_2O$);

and a hydrated or nonhydrated zinc borate, for example ($2ZnO.3B_2O_3.7/2.H_2O$);

(b) together with the aforementioned ternary composition, keeping the total weight content of inorganic matter in the composite yarn, including the core, within a range of between 4% and 65%.

Preferably, the total weight content of inorganic matter in the sheath is between 4% and 15%.

Advantageously, the fire-retarding filler consists of said ternary composition.

By way of chlorinated polymer material, it is possible to use, according to the invention, any PVC resin capable of being plasticized, and especially able consequently to be processed in the form of a plastisol.

Preferably, the polyvinyl chlorides according to the present invention have a K value of between 65 and 75.

The term "chlorinated polymer material" should be understood to mean a pure chlorinated polymer or a copolymer of vinyl chloride copolymerized with other monomers, or else a chlorinated polymer which is alloyed with other polymers.

Among the monomers which may be copolymerized with vinyl chloride, mention may be made in particular of olefins, such as ethylene for example, vinyl esters of saturated carboxylic acids, such as vinyl acetate or vinyl butyrate, halogenated vinyl derivatives such as, for example, vinylidene chloride, and acrylic or methacrylic acid esters, such as butyl acrylate.

By way of chlorinated polymer, mention may be made, for example, of polyvinyl chloride but also postchlorinated PVCs, polyvinylidene chlorides and chlorinated polyolefins.

Preferably, but not exclusively, the chlorinated polymer material according to the present invention has a halogen weight content of between 50 and 70%.

With regard to the continuous yarn forming or included in the core of the composite yarn, this may itself consist of one or more continuous filaments. Its chemical nature may be organic, for example in the case of a polyester, or inorganic, for example in the case of glass or silica, it being understood that its melting point must be above the temperature at which the polymer material of the matrix forming the sheath or jacket of the composite yarn is processed.

Other fillers may be incorporated into and distributed within the matrix of the sheath in addition to the fire-retarding filler, for example a pigmenting filler and/or a stabilizing filler. Likewise, the total weight content of the composite yarn in terms of inorganic matter is also obviously modified or affected by the content of inorganic matter of these additional fillers.

By virtue of the invention, it remains possible to use conventional plasticizers for the plastic matrix, for example comprising at least one organic phthalate, and consequently not to compromise the processing properties of the yarn with respect to its subsequent weaving.

The invention also makes it possible to limit the amount of fire-retarding filler by weight to amounts not exceeding 65% of the plastic matrix, which is conducive to satisfactory weaving of the yarn according to the invention. Above 65%, the sheath becomes coated with powder, which adversely affects the properties, especially the mechanical properties, of the composite yarn.

The present invention, by remaining with a composite yarn obtained by coating, therefore provides the actual yarn with a fire behavior very close to that of a yarn of inorganic nature. Furthermore, the woven fabrics obtained from a composite yarn according to the invention do not need a post-treatment to improve their fire behavior.

It also turns out, from tests by the Applicant, that the composite yarns according to the present invention are very light-resistant and weather-resistant.

Preferably:

the plasticizer weight content of a composite yarn according to the invention does not exceed 40% and is preferably between 10 and 20%; above 35% of plasticizer, the latter bleeds from the matrix of the sheath or jacket;

and/or the ternary composition of the fire-retarding filler combines, in approximately equal parts by weight, the oxygenated antimony compound, the hydrated metal oxide and zinc borate.

The present invention relies on the following experimental protocol.

A plastisol comprising the polymer material and a plasticizer is first of all formulated according to the following composition by weight:

60 to 65% of one or more polyvinyl chloride resins (commercial name ECKAVYL EF701 from Atochem);

20 to 30% of an isononyl phthalate (commercial name JAYFLEX DINP from Exxon);

various additives making up the balance, including an inorganic heat stabilizer (from 1.5 to 2%).

Incorporated into this plasticizer was a ternary fire-retarding filler, combining, in equal parts by weight:

antimony trioxide, $Sb_2O_3$;

alumina hydrate, $Al_2O_3.3H_2O$; and zinc borate ($2ZnO.3B_2O_3.7/2\ H_2O$), hereinafter referred to as ZnBo.

A glass yarn core is then coated with the filled plastisol in order to obtain a composite yarn according to the present invention.

This yarn is woven according to various weaves, or specifications, specified hereinbelow.

According to the table below, in which M1 and B1 denote the highest classification levels according to the German and French regulations, respectively, for an organic material, it may first of all be seen that the ternary combination of the above three compounds was necessary for obtaining both the M1 classification and the B1 classification, this being so for woven fabrics obtained from a yarn according to the present invention with the following weaves:

18/14 sateen construction

14/14 plain-weave construction.

| | M1 | B1 |
|---|---|---|
| $Sb_2O_3$ | yes | no |
| $Al_2O_3.3H_2O$ | no | no |
| ZnBo | no | no |
| $Sb_2O_3$ + ($Al_2O_3.3H_2O$) | no | yes |
| $Sb_2O_3$ + ZnBo | yes | no |
| ZnBo + ($Al_2O_3.3H_2O$) | no | no |

Various yarns were then obtained from respectively different compositions by weight (in %), depending on the desired linear density, according to the table below:

| Linear density | 165 tex | 97 tex |
|---|---|---|
| Glass core | 41.0 | 35.0 |
| Sheath or jacket | 59.0 | 65.0 |
| Polyvinyl chloride | 33 | 37 |
| Fire-retarding filler | 9.0 | 10 |
| Plasticizer (1) | 13.5 | 15.0 |
| Total weight content of inorganic matter (2) | 52 | 47 |

(1) the percentages are expressed with respect to the total weight of the glass core and of the jacket, corresponding to 100%;

(2) taking into account the optional presence of fillers other than fire retardants, for example pigmenting fillers.

A composite yarn according to the present invention may be incorporated or assembled into any required textile structure, namely two-dimensional structures (sheets, woven fabrics, etc.) or three-dimensional structures (for example, braids).

The composite yarn may first of all be cut and divided into individual yarns, which may be intermingled and fastened to one another in the form of nonwoven textile structures, for example mats. The individual intermingled yarns may be fastened together by impregnation with a suitable adhesive substance, or else by thermal fusion of the polymer material of the sheath. Next, the composite yarn may be assembled on itself, into any suitable knitted textile structure; but it may be assembled with other yarns, whether according to the present invention or not, in order to form two-dimensional structures; in the latter case, these may be meshes in which the yarns according to the present invention are interlaced and fastened to other yarns, whether according to the present invention or not, or are woven fabrics in which the composite yarns according to the invention are woven with other weft and/or warp yarns, again whether or not according to the invention.

One very particular application of the present invention relates to the formation of high-performance woven fabrics intended for the production or manufacture of both interior and exterior blinds or curtains.

In order to form blinds, the yarns obtained according to the aforementioned experimental protocol were woven, by way of example, into the following weaves or specifications:

18/14 sateen construction

14/14 plain-weave construction.

After fire tests, all these woven fabrics showed that they met both the German regulations with the B1 classification and the French regulations with the M1 and F3 classification.

What is claimed is:

1. A composite yarn comprising a core composed of a continuous yarn, and a coated sheath composed of a matrix comprising of at least one chlorinated polymer material, and a fire-retarding filler incorporated into and distributed within said matrix, wherein, in combination, the fire-retarding filler comprises a ternary composition which combines an oxygenated antimony compound, a hydrated metal oxide, the metal of which is chosen from the group consisting of aluminum, magnesium, tin, zinc and lead, and a zinc borate and, together with said ternary composition, the total weight content of inorganic matter in the yarn is between 4% and 65%.

2. The composite yarn of claim 1, wherein the total weight content of inorganic matter in the sheath is between 4 and 15%.

3. A textile structure, comprising at least one composite yarn according to claim 2.

4. The composite yarn of claim 1, wherein the fire-retarding filler consists of said ternary composition.

5. A textile structure, comprising at least one composite yarn according to claim 4.

6. The composite yarn of claim 1, further comprising a plasticizer comprising at least one organic phthalate.

7. The composite yarn of claim 6, wherein the plasticizer has a weight content of said yarn that does not exceed 40%.

8. A textile structure, comprising at least one composite yarn according to claim 7.

9. The composite yarn of claim 7, wherein said weight content is preferably between 10 and 20%.

10. A textile structure, comprising at least one composite yarn according to claim 6.

11. The composite yarn of claim 1, wherein the ternary composition of the fire-retarding filler combines, in approximately equal parts by weight, the oxygenated antimony compound, the hydrated metal oxide and the zinc borate.

12. A textile structure, comprising at least one composite yarn according to claim 11.

13. A textile structure comprising, at least one composite yarn according to claim 1.

14. The textile structure of claim 13 comprising a textile sheet, woven or nonwoven, formed into a fabric and obtained by warp or weft weaving of said composite yarn.

15. A blind or curtain comprising a cloth comprising a woven fabric according to claim 14.

16. The composite yarn of claim 1 wherein said yarn is comprised of an inorganic material.

17. The composite yarn of claim 16 wherein said inorganic material is glass.

18. The composite yarn of claim 1, wherein said chlorinated polymer material is polyvinyl chloride.

19. The composite yarn of claim 1, wherein said oxygenated antimony compound is antimony trioxide.

20. The composite yarn of claim 1, wherein said hydrated metal oxide is alumina hydrate.

* * * * *